United States Patent [19]

Anderson

[11] Patent Number: 5,041,707

[45] Date of Patent: Aug. 20, 1991

[54] ELECTROMAGNETIC INTERFERENCE SHIELDED SWITCH

[75] Inventor: W. Kyle Anderson, Rockford, Ill.

[73] Assignee: Sundstrand Corporation, Rockford, Ill.

[21] Appl. No.: 436,022

[22] Filed: Nov. 14, 1989

[51] Int. Cl.[5] ..... H01H 9/02

[52] U.S. Cl. ..... 200/305; 361/212

[58] Field of Search ..... 200/52 R, 304, 305; 361/212, 220; 174/35 R, 35 C

[56] References Cited

U.S. PATENT DOCUMENTS

| | | | |
|---|---|---|---|
| 3,566,064 | 6/1969 | Neillis | 200/305 |
| 3,987,263 | 10/1976 | Ogasawara | 200/550 |
| 4,185,176 | 1/1980 | Matsuo | 200/16 D |
| 4,336,529 | 6/1982 | Buan | 364/409 |
| 4,507,627 | 3/1985 | Ito et al. | 200/305 X |
| 4,567,318 | 1/1986 | Shu | 174/35 GC |
| 4,692,576 | 9/1987 | Frede | 200/305 X |
| 4,737,597 | 4/1988 | Tomiya et al. | 174/35 R |

*Primary Examiner*—J. R. Scott

*Attorney, Agent, or Firm*—Antonelli, Terry, Stout & Kraus

[57] ABSTRACT

A switch assembly (60) shielded against electromagnetic interference in accordance with the present invention includes a first housing (15) defining a volume within which a switch (16) is disposed and a first opening not providing shielding against electromagnetic interference penetrating into the volume (39) through which at least two electrical conductors (12) pass which are electrically connected to the switch, the first housing providing shielding against electromagnetic interference penetrating into the volume through the wall; a cable (44) shielded against electromagnetic interference, attached to a cover plate (65) with the at least two conductors being contained within the cable, the cover plate shielding against penetration of electromagnetic interference; a second housing (62) deposed outside of, contacting and containing the first housing, the second housing defining a second opening (64) not providing shielding against penetration of electromagnetic interference into the second housing; and the cover plate being joined to the second opening by an attachment (68) which shields against penetration of electromagnetic interference into the second housing.

10 Claims, 1 Drawing Sheet

ELECTROMAGNETIC INTERFERENCE SHIELDED SWITCH

DESCRIPTION

1. Technical Field

The present invention relates to switches which are shielded from electromagnetic interference (EMI) or electromagnetic pulse (EMP) which hereinafter will collectively be referred to as EMI.

2. Background Art

FIG. 1 illustrates a position indicating switch assembly typical of switches utilized on military aircraft. The switch assembly 10 has a specification requiring shielding against EMI to prevent high intensity electromagnetic fields from inducing false signal states within electrical conductors 12 contained within a metallic housing 14. The switch 16 is mounted on a mounting assembly (not illustrated). The switch 16 is illustrated only schematically with it being understood that the precise design of the contact structure of the switch is not illustrated. The switch 16 has a member 17 which is moveable between first and second positions. In practice the actual switch 16 may be an over center snap acting contact type. An EMI shield 24 (metal bellows) prevents EMI from entering into the interior volume within the housing 14 through a hole (not illustrated) cut in the wall 20 of the housing. A pivotable member 26 is mounted on the housing 14 at attachment point 28. The pivotable member 26 is pivotable between a first open position as illustrated and a second closed position which causes the switch to electrically connect conductors 12. A pair of holes 30 extend through the housing 14 for receiving fasteners for attaching the housing to a mounting plate (not illustrated). It should be noted that the holes do not permit vertical adjustment of the housing 14 with respect to the mounting plate. A follower 32 is attached to end 34 of the pivotable member 26. Actuation of the switch which connects conductors 12 is caused by the follower 32 engaging another movable surface not illustrated.

Housing 14 defines an opening extending downward from the switch 16 which is sealed by conventional potting material 38. The potting material 38 is poured into the housing and has a level indicated by the dotted line 36. The opening 39 is not shielded against EMI.

The foregoing switch assembly 10 is commercially available from a vendor. In order to completely shield the switch assembly 10 against EMI, the conventional housing 14 is extended downward with an extension 40 attached by tack welds 47 to the housing to provide a special purpose housing suited for an application in military aircraft. The extension 40 defines an opening 42. A coaxial assembly 44 includes a shielded cable 45. The cable assembly is of conventional construction and is attached to cover plate 46 by tack welds 48 and the cover plate is attached to the opening 42 by tack welds 50 to provide an enclosure for the switch 16.

The switch assembly 10 of FIG. 1 had several disadvantages. In the first place, as a consequence of the requirement to provide complete EMI shielding for the switch 16, it was necessary to modify the standard switch assembly to provide EMI shielding for the opening 39 closed by the potting material 38. The modification of housing 14 to extend it downward to provide the extension 40 was expensive in the sense that it created a special purpose switch assembly. Furthermore, the connection of the coaxial cable assembly 44 by tack welds 48 to the cover plate 46 and the attachment of the cover plate to the opening 42 by tack welds 50 did not provide a highly efficient electromagnetic interference seal. This is a consequence of the fact that the clearance between the tack welded parts is not minimized which is a design requirement for obtaining a high efficiency EMI seal. Furthermore, the tack welds 48 and 50 were subject to breakage during assembly as a consequence of loads placed on the coaxial cable assembly 44. Finally, due to limited adjustability the pivotable member 26 must be held to excessively tight tolerances in order to comply with a specification regarding precise positional opening and closure of the switch. The lack of a vertical adjustment in the position of the switch assembly 10 with respect to the mounting plate to which the switch was attached precluded compliance with the precise specification regarding switch closure through adjustment.

DISCLOSURE OF INVENTION

The present invention provides a low cost switch assembly shielded against EMI. The low cost is achieved by utilizing a standard switch assembly which has an opening that is not shielded against EMI and providing a second housing disposed outside of, contacting and containing the first housing of the standard switch assembly which defines a new opening to which is attached a coaxial cable assembly by an attachment which provides an EMI shield between the new opening defined by the second housing attached to the first housing of the switch and the cover plate of the cable assembly. Additionally, an adjustment mechanism is provided to permit adjustment of the location of the switch assembly with respect to a mounting plate to which the switch assembly is attached to adjust switch opening and closing specifications to provide compensation for switch members with large position tolerance which are not usable as discussed in the prior art because of the precise switch opening and closing specification. Accordingly, the present invention provides a better EMI shield than the prior art at lower cost while further permitting adjustment of opening and closing specifications to allow increased tolerance in the position of the switch members.

A switch assembly shielded against electromagnetic interference in accordance with the invention includes a first housing defining a volume within which a switch is disposed and a first opening not providing shielding against electromagnetic interference penetrating into the volume through which at least two electrical conductors pass which are electrically connected to the switch, the first housing having a wall providing shielding against electromagnetic interference penetrating into the volume through a wall; a cable, shielded against electromagnetic interference, attached to a cover plate with the at least two electrical conductors being contained within the cable, the cover plate providing shielding against penetration of electromagnetic interference through the cover plate; a second housing disposed outside of, contacting and containing the first housing, the second housing defining a second opening not providing shielding against penetration of electromagnetic interference into the second housing; and the cover plate joined to the second opening by an attachment which is not penetrable by electromagnetic interference into the second housing. The attachment forms an electromagnetic shield between the cover plate and the second opening.

A mounting flange is attached to the second housing having a pivot point about which the flange is rotatable when a fastener is contained within the pivot point and fixedly attached to a mounting member and a slot offset from the pivot point which subtends an arc within the slot with the arc defining a direction of movement having a component of motion parallel to the direction of pivoting of the pivotable member with movement about the pivot point being prevented when a fastener is contained within the slot and attached to the mounting member. The first and second housings are metallic and the first housing is inserted within the second housing and secured. The cover plate is attached by inelastically deforming the second housing.

BEST MODE FOR CARRYING OUT THE INVENTION

Figure 1:
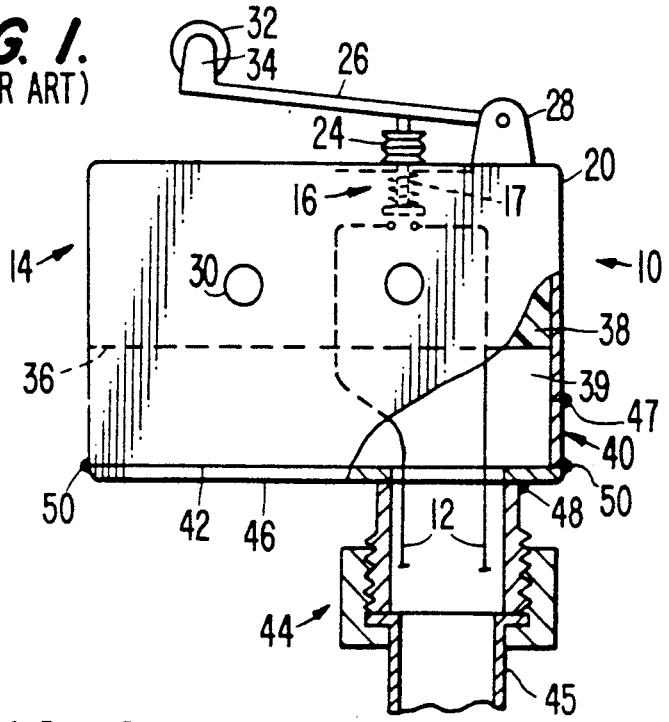
FIG. 1. (PRIOR ART)
FIG. 1 illustrates a prior art switch shielded against electromagnetic interference.
Figure 2:
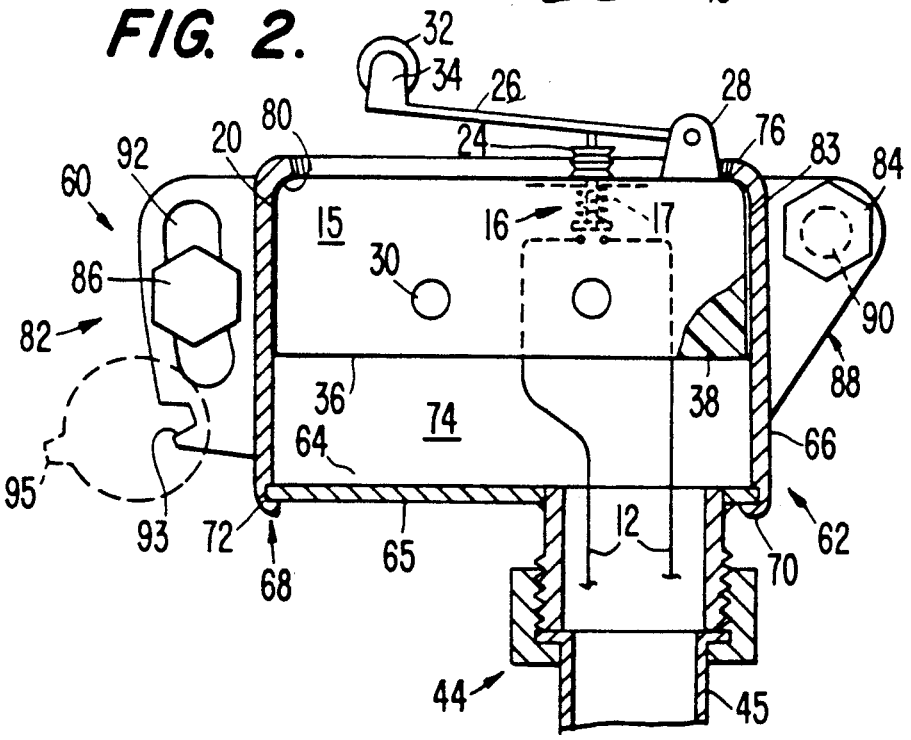
FIG. 2 illustrates an elevational view of a switch shielded against electromagnetic interference in accordance with the present invention.
Figure 3:
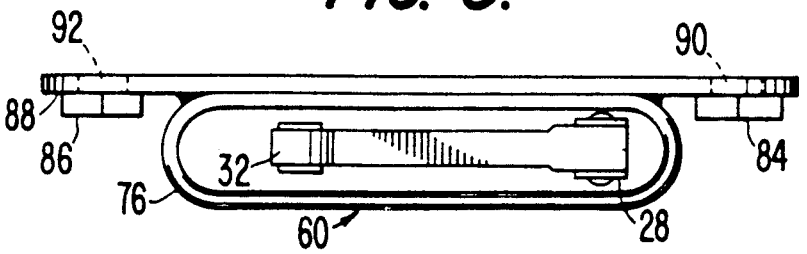
FIG. 3 illustrates a top view of the present invention.

FIGS. 2 and 3 illustrate an embodiment of a switch assembly 60 in accordance with the present invention. Like reference numerals identify like parts in FIGS. 1-3. The embodiment utilizes a commercially available switch assembly like the portion of the prior art of FIG. 1 above the opening 39 which may be but is not limited to being in accordance with FIG. 1 without the extension 40 and end plate 46. The switch assembly 60 provides an effective electromagnetic interference shield by providing a metallic second outer housing 62 disposed outside of, contacting and containing the first metallic inner housing 15. The second housing 62 is inelastically deformed to maintain its shape to contact the first housing 15. The second housing 62 defines a second opening 64 which is closed by cover plate 65. The cover plate 65 is attached to the second housing 62 by an attachment 68 which shields against penetration of electromagnetic interference. The attachment 68, which preferably is produced by crimping an edge 70 by inelastic deformation around cover plate 65 which is received in a slot 72 within the bottom portion of the wall 66 of the second housing 62 in proximity to the second opening 64. The attachment 68 provided by crimping provides a highly effective electromagnetic interference shield at low cost which prevents electromagnetic interference from penetrating into the volume 74. A rounded corner 76 in the upper part of the wall 66 contacts an upper edge 80 of the inner housing 15. This locates the inner housing 15 in the outer housing 62. The commercially available switch assembly is retained by adhesive or a spacer (not shown) so that the inner housing 15 is located so the upper edge 80 of the inner housing contacts the inner corner of the bent section 76 of the outer housing 62. EMI shielding is assured by the long narrow gap 83 created between the two metallic inner and outer housings 15 and 62 and the curve at edge 80.

An adjustment mechanism 82 for varying the relative position of the surface for closing the switch 16 and the follower 32 is described as follows. The adjustment mechanism 82 permits vertical adjustment of the location of the commercially available switch assembly with respect to a mounting member (not illustrated) to which fasteners 84 and 86 are joined. A mounting plate 88 has an aperture 90 for receiving fastener 84 which permits pivoting of the plate around the fastener. The mounting plate 88 also has a slot 92 which subtends an arc for pivoting of the mounting plate 88 around the fastener 84. The fastener 86 fitting in slot 92 permits the clamping of the mounting plate 88 in a fixed vertical position with respect to the member to which the mounting plate 88 is attached. The purpose of the adjustment slot 92 is to permit vertical adjustment of the position of the switch assembly 60 to allow a pivotable member 26 to be used with tolerances that are within industrially accepted limits as discussed above while permitting compliance with more stringent positional specifications on opening and closure of the switching assembly 16 required by the military. A slot 93 is provided in mounting plate 88 to aid in fine adjustment of pivotable member 26. A tool, such as a screwdriver, can be inserted between this slot 93 and a slotted hole 95 located in the mounting member (not illustrated).

The utilization of the outer housing 62 to form a volume which is shielded against electromagnetic interference permits a lower cost switch assembly 60 to be manufactured from commercially available switch assemblies, such as the top portion of the prior art of FIG. 1, which are not fully shielded against electromagnetic interference. The invention overcomes the disadvantages of the prior art discussed above with respect to FIG. 1 while provided a high level of shielding against electromagnetic interference penetrating into the volume within the inner housing 15 containing the potting material 38 and the volume 74 which is defined by outer housing 62 and cover plate 65.

While the invention has been described in terms of its preferred embodiment, it should be understood that numerous modifications may be made thereto without departing from the spirit and scope of the invention. It is intended that all such modifications fall within the scope of the appended claims.

I claim:

1. A switch assembly shielded against electromagnetic interference comprising:

a first housing defining a volume within which a switch is disposed and a first opening not providing shielding against electromagnetic interference penetrating into the volume through which at least two electrical conductors pass which are electrically connected to the switch, the first housing having a wall providing shielding against electromagnetic interference penetrating into the volume through the wall;

a cable assembly, shielded against electromagnetic interference, attached to a cover plate with the at least two electrical conductors being contained within the cable assembly, the cover plate providing shielding against penetration of electromagnetic radiation through the cover plate;

a second housing disposed outside of, contacting and containing the first housing, the second housing defining a second opening not providing shielding against penetration of electromagnetic interference into the second housing; and the cover plate being joined to the second opening by an attachment which shields against penetration of electromagnetic interference into the second housing.

2. A switch assembly in accordance with claim 1 further comprising:

a sealant closing the first opening with the at least two electrical conductors extending through the sealant to outside the first housing, the sealant being penetrable by electromagnetic interference.

3. A switch assembly in accordance with claim 2 further comprising:

a pivotable member pivotally attached to one of the housings and pivoting to engage a switch member to cause movement of the switch member between first and second positions to open and close the switch.

4. A switch assembly in accordance with claim 3 further comprising:

an electromagnetic interference shield disposed between the switch member and the at least one housing through which the switch member extends.

5. A switch assembly in accordance with claim 4 further comprising:

a mounting flange attached to at least one of the housings having a pivot point about which the flange is rotatable when a fastener is contained within the pivot point and fixedly attached to a mounting member and a slot offset from the pivot point which subtends an arc within the slot with the arc defining movement having a component of motion parallel to the direction of pivoting of the pivotable member with movement about the pivot point being prevented when a fastener is contained within the slot and attached to the mounting member.

6. A switch assembly in accordance with claim 1 wherein:

the first and second housings are metallic; and the second housing has a curved section contacting a curved section of the first housing and is inelastically deformed to form the attachment of the second housing to the cover plate.

7. A switch assembly in accordance with claim 2 wherein:

the first and second housings are metallic; and the second housing has a curved section contacting a curved section of the first housing and is inelastically deformed to form the attachment of the second housing to the cover plate.

8. A switch assembly in accordance with claim 3 wherein:

the first and second housings are metallic; and the second housing has a curved section contacting a curved section of the first housing and is inelastically deformed to form the attachment of the second housing to the cover plate.

9. A switch assembly in accordance with claim 4 wherein:

the first and second housings are metallic; and the second housing has a curved section contacting a curved section of the first housing and is inelastically deformed to form the attachment of the second housing to the cover plate.

10. A switch assembly in accordance with claim 5 wherein:

the first and second housings are metallic; and the second housing has a curved section contacting a curved section of the first housing and is inelastically deformed to form the attachment of the second housing to the cover plate.

* * * * *